US011859469B2

(12) United States Patent
Almuayli et al.

(10) Patent No.: US 11,859,469 B2
(45) Date of Patent: Jan. 2, 2024

(54) UTILIZING NATURAL GAS FLARING BYPRODUCTS FOR LIQUID UNLOADING IN GAS WELLS

(71) Applicant: Saudi Arabian Oil Company, Dhahran (SA)

(72) Inventors: Muath Fahad Almuayli, Dammam (SA); Adel Ali Al-Qahtani, Khobar (SA)

(73) Assignee: Saudi Arabian Oil Company, Dhahran (SA)

( * ) Notice: Subject to any disclaimer, the term of this patent is extended or adjusted under 35 U.S.C. 154(b) by 213 days.

(21) Appl. No.: 17/506,360

(22) Filed: Oct. 20, 2021

(65) Prior Publication Data

US 2023/0120702 A1 Apr. 20, 2023

(51) Int. Cl.
*E21B 41/00* (2006.01)
*F23G 7/08* (2006.01)

(52) U.S. Cl.
CPC ..... *E21B 41/0071* (2013.01); *F23G 7/08* (2013.01); *F23G 2207/20* (2013.01); *F23G 2209/14* (2013.01)

(58) Field of Classification Search
CPC .... F23G 2209/14; F23G 2207/20; F23G 7/08; E21B 41/0071
USPC ..... 431/202
See application file for complete search history.

(56) References Cited

U.S. PATENT DOCUMENTS

| | | | | |
|---|---|---|---|---|
| 2,173,556 | A * | 9/1939 | Hixon | E21B 43/168 166/57 |
| 3,720,263 | A | 3/1973 | Murphy et al. | |
| 8,768,671 | B2 | 7/2014 | Lee | |
| 9,556,720 | B2 | 1/2017 | Onda | |
| 10,087,722 | B2 | 10/2018 | Lecerf et al. | |
| 10,280,731 | B2 | 5/2019 | Aitken | |
| 2007/0294034 | A1 | 12/2007 | Bratton | |
| 2013/0311147 | A1 | 11/2013 | Greenwood | |
| 2016/0115771 | A1 | 4/2016 | Ganguly et al. | |

(Continued)

FOREIGN PATENT DOCUMENTS

RU 2687668 5/2019

OTHER PUBLICATIONS

Dylan Brown, et al. "Capturing Value From Natural Gas: Mitigating the Flaring of Natural Gas in North Dakota A comprehensive report on pathways for mitigation of natural gas flaring". Energy and the Environment Certificate Duke University Design Capstone Report. 2017 (Year: 2017).*

(Continued)

*Primary Examiner* — Vivek K Shirsat
(74) *Attorney, Agent, or Firm* — Fish & Richardson P.C.

(57) ABSTRACT

A production stream is received from a well formed in a subterranean formation. The production stream includes a gaseous portion and a liquid portion. The liquid portion has a base sediment and water (BS&W) percentage. At least a portion of the gaseous portion of the production stream is combusted to produce a flaring byproduct stream. The flaring byproduct stream is flowed through a coiled tubing to the well. The BS&W percentage of the liquid portion of the production stream is measured. The flow of the flaring byproduct stream to the well is decreased in response to the BS&W percentage reaching a threshold BS&W percentage.

16 Claims, 6 Drawing Sheets

(56) References Cited

U.S. PATENT DOCUMENTS

| | | | | |
|---|---|---|---|---|
| 2017/0103144 | A1 | 4/2017 | Badri | |
| 2018/0355707 | A1 | 12/2018 | Rodriguez | |
| 2021/0115772 | A1* | 4/2021 | Ejim | E21B 43/38 |
| 2021/0302619 | A1 | 9/2021 | Al-Qahtani et al. | |

OTHER PUBLICATIONS

"Steering Techniques" ED—Darl Kuhn, An IP.com Prior Art Database Technical Disclosure, Jun. 2014, XP013163163, 32 pages.

Abuhesa, "Investigation Into Gas Flaring Reduction in the Oil and Gas Industry," Thesis for the degree of Doctor of Philosophy, School of Computing, Sciences, and Engineering, University of Salford, Manchester, United Kingdom, Dec. 2010, 336 pages.

Aldawood et al., "Integrated Pre-Well Planning Process to Improve Service Quality and Decrease Risk by Cooperation between Drilling and Geoscience," Society of Petroleum Engineers, Jan. 1, 2011, 8 pages.

Aliyeva, et al., "Gas Lift—Fast and Furious," SPE Annual Caspian Technical Conference & Exhibition, Nov. 2015.

Al-Mulhim, et al., "Utilization of Onsite Nitrogen Generation Technology as a Replacement for Conventional Liquid Nitrogen for Unloading Wells: a Novel and Cost Effective Alternative with Less Carbon Footprint on the Environment," International Petroleum Technology Conference, Jan. 2014.

Cayeux et al., "Well Planning Quality Improved Using Cooperation between Drilling and Geosciences," Society of Petroleum Engineers, Jan. 1, 2001, 9 pages.

Denney, "Gas Lift With On-Site-Generated Nitrogen," J Pet Technol, May 2000, 52(5): 26-27.

Gui et al., "Well Planning and Stimulation Optimisation by Integrating 3D Geomechanics for a Horizontal Well in the Northern Cooper Basin," Society of Petroleum Engineers, Oct. 25, 2016, 15 pages.

Hossam et al., Modeling and Validation of Fluid Flow-Geomechnics of Mauddud Reservoir in Sabriya Field* Search and Discovery Article #41052, Oct. 2012, 14 pages.

Lozada Aguilar, et al., "Gas Lift With Nitrogen Injection Generated In Situ," SPE International Petroleum Conference and Exhibition, Feb. 2000.

Martinez, "CO2 Gas Lift—Is It Right For You?," SPE Mid-Continent Operations Symposium, Mar. 1999.

Mason and Chen, "The Perfect Wellbore," SPE 95279 presented at the SPE Annual Technical Conference and Exhibition held in Dallas, Texas, USA, Oct. 9-12, 2005, 15 pages.

Rahman et al., "Geomechanical sweet spot identification in unconventional resources development," SPE-182247-MS, Society of Petroleum Engineers, presented at the SPE Asia Pacific Oil & Gas Conference and Exhibition held in Perth, Australia, Oct. 25-27, 2016, 19 pages.

Setiati et al., "The Potential of CO2 Injection on Enhanced Oil Recovery Method for Oil Fields in Indonesia," International Conference of Science Management Art Research Technology, 2020, 1(1):33-43.

Suarez-Rivera et al., "Seismic-Based Heterogeneous Earth Model Improves Mapping Reservoir Quality and Completion Quality in Tight Shales," Society of Petroleum Engineers, Apr. 10, 2013, 11 pages.

* cited by examiner

UTILIZING NATURAL GAS FLARING BYPRODUCTS FOR LIQUID UNLOADING IN GAS WELLS

TECHNICAL FIELD

This disclosure relates to liquid unloading in gas wells.

BACKGROUND

As natural gas is produced from a well formed in a subterranean formation, liquids (for example, oil, condensate, and/or water) may accumulate over time. Liquids may accumulate due to a variety of factors, for example, a decrease in gas velocity in the well, a decrease in reservoir pressure, and/or a change in gas-to-liquid ratio. In some cases, liquid that is used to stimulate a well accumulates in the well due to the limited capability of the reservoir's pressure to carry the stimulation liquid out of the well. The accumulated liquids can negatively impact production of natural gas from the well. For example, as liquids accumulate in the well, natural gas production from the well may decline due to an increase in hydrostatic pressure in the well caused by the accumulation of liquid.

SUMMARY

This disclosure describes technologies relating to utilizing natural gas flaring byproducts for liquid unloading in gas wells. Certain aspects of the subject matter described can be implemented as a method. A quantity of a nitrogen stream is flowed through a coiled tubing to a well formed in a subterranean formation to begin a liquid unloading process in the well. A production stream is received from the well in response to flowing the nitrogen stream. At least a portion of the production stream is combusted to produce a flaring byproduct stream. A quantity of the flaring byproduct stream is flowed with the nitrogen stream through the coiled tubing to the well to continue the liquid unloading process in the well. A flow rate of the flaring byproduct stream is measured. The flow of the nitrogen stream to the well is decreased in response to the flow rate of the flaring byproduct stream reaching a threshold flow rate. A base sediment and water (BS&W) percentage of the production stream is measured. The flow of the flaring byproduct stream to the well is decreased in response to the BS&W percentage reaching a threshold BS&W percentage.

This, and other aspects, can include one or more of the following features. In some implementations, the threshold flow rate is about 700 standard cubic feet per minute (SCFM). In some implementations, the threshold BS&W percentage is about 10%. In some implementations, the flaring byproduct stream includes about 99 volume percent (vol. %) of carbon dioxide. In some implementations, the flaring byproduct stream is cooled before flowing the flaring byproduct stream with the nitrogen stream through the coiled tubing to the well. In some implementations, the flow of the nitrogen stream to the well is decreased until the flow of the nitrogen stream to the well stops. In some implementations, the flow of the flaring byproduct stream to the well is decreased until the flow of the flaring byproduct stream to the well stops. In some implementations, the well is fluidically connected to a gas processing plant after the flow of the flaring byproduct stream to the well stops. In some implementations, the well is fluidically connected to a gas pipeline after the flow of the flaring byproduct stream to the well stops.

Certain aspects of the subject matter described can be implemented as a method. A production stream is received from a well formed in a subterranean formation. The production stream includes a gaseous portion and a liquid portion. The liquid portion has a BS&W percentage. At least a portion of the gaseous portion of the production stream is combusted to produce a flaring byproduct stream. The flaring byproduct stream is flowed through a coiled tubing to the well. The BS&W percentage of the liquid portion of the production stream is measured. The flow of the flaring byproduct stream to the well is decreased in response to the BS&W percentage reaching a threshold BS&W percentage.

This, and other aspects, can include one or more of the following features. In some implementations, the threshold BS&W percentage is about 10%. In some implementations, the flaring byproduct stream includes about 99 volume percent (vol. %) of carbon dioxide. In some implementations, the flaring byproduct stream is cooled before flowing the flaring byproduct stream through the coiled tubing to the well. In some implementations, the flow of the flaring byproduct stream to the well is decreased until the flow of the flaring byproduct stream to the well stops. In some implementations, the well is fluidically connected to a gas processing plant after the flow of the flaring byproduct stream to the well stops. In some implementations, the well is fluidically connected to a gas pipeline after the flow of the flaring byproduct stream to the well stops.

The details of one or more implementations of the subject matter of this disclosure are set forth in the accompanying drawings and the description. Other features, aspects, and advantages of the subject matter will become apparent from the description, the drawings, and the claims.

DETAILED DESCRIPTION

This disclosure describes technologies relating to utilizing natural gas flaring byproducts for liquid unloading in gas wells. Natural gas flaring byproducts during flowback from a gas well can be used to perform post-stimulation liquid unloading and condensate unloading in the same gas well. Natural gas produced during the post-stimulation clean-up process before connecting the well to a production line is typically flared and released to the atmosphere. As described in this disclosure, the otherwise wasted flaring byproducts can be used by pumping the byproducts through a coiled tubing into a gas well to facilitate liquid unloading from the gas well. The flaring byproducts are therefore circulated through the gas well to unload liquids from the well. The subject matter described in this disclosure can be implemented in particular implementations, so as to realize one or more of the following advantages. The use of such flaring byproducts for this purpose can reduce the demand of nitrogen, which is typically used in liquid unloading processes. Further, the use of the flaring byproducts into a gas well to displace liquid from the same gas well can improve clean-up processes in preparation for hydrocarbon recovery.

Figure 1:
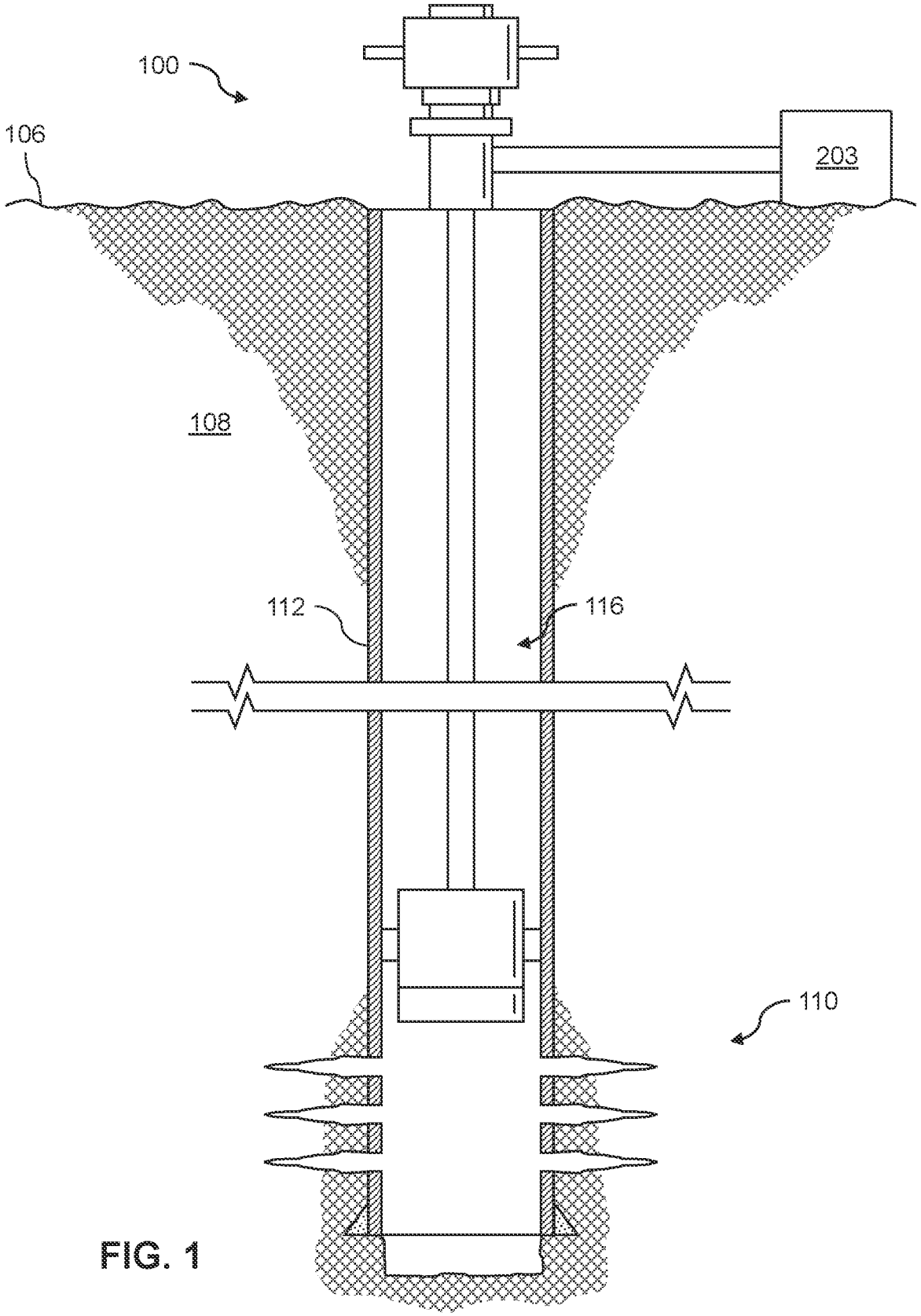
FIG. 1 is a schematic diagram of an example well.

FIG. 1 depicts an example well 100 constructed in accordance with the concepts herein. The well 100 extends from the surface 106 through the Earth 108 to one more subterranean zones of interest 110 (one shown). The well 100 enables access to the subterranean zones of interest 110 to allow recovery (that is, production) of fluids to the surface 106 (represented by flow arrows in FIG. 1) and, in some implementations, additionally or alternatively allows fluids to be placed in the Earth 108. In some implementations, the subterranean zone 110 is a formation within the Earth 108 defining a reservoir, but in other instances, the zone 110 can be multiple formations or a portion of a formation. The subterranean zone can include, for example, a formation, a portion of a formation, or multiple formations in a hydrocarbon-bearing reservoir from which recovery operations can be practiced to recover trapped hydrocarbons. In some implementations, the subterranean zone includes an underground formation of naturally fractured or porous rock containing hydrocarbons (for example, oil, gas, or both). In some implementations, the well can intersect other types of formations, including reservoirs that are not naturally fractured. For simplicity's sake, the well 100 is shown as a vertical well, but in other instances, the well 100 can be a deviated well with a wellbore deviated from vertical (for example, horizontal or slanted), the well 100 can include multiple bores forming a multilateral well (that is, a well having multiple lateral wells branching off another well or wells), or both.

In some implementations, the well 100 is a gas well that is used in producing hydrocarbon gas (such as natural gas) from the subterranean zones of interest 110 to the surface 106. While termed a "gas well," the well can produce dry gas and may incidentally, or in much smaller quantities, produce liquid including oil, water, or both. In some implementations, the production from the well 100 can be multiphase in any ratio. In some implementations, the production from the well 100 can produce mostly or entirely liquid at certain times and mostly or entirely gas at other times. For example, in certain types of wells it is common to produce water for a period of time to gain access to the gas in the subterranean zone. The concepts herein, though, are not limited in applicability to gas wells, oil wells, or even production wells, and could be used in wells for producing other gas or liquid resources or could be used in injection wells, disposal wells, or other types of wells used in placing fluids into the Earth.

The wellbore of the well 100 is typically, although not necessarily, cylindrical. All or a portion of the wellbore is lined with a tubing, such as casing 112. The casing 112 connects with a wellhead at the surface 106 and extends downhole into the wellbore. The casing 112 operates to isolate the bore of the well 100, defined in the cased portion of the well 100 by the inner bore 116 of the casing 112, from the surrounding Earth 108. The casing 112 can be formed of a single continuous tubing or multiple lengths of tubing joined (for example, threadedly) end-to-end. In FIG. 1, the casing 112 is perforated in the subterranean zone of interest 110 to allow fluid communication between the subterranean zone of interest 110 and the bore 116 of the casing 112. In some implementations, the casing 112 is omitted or ceases in the region of the subterranean zone of interest 110. This portion of the well 100 without casing is often referred to as "open hole." The wellhead defines an attachment point for other equipment to be attached to the well 100. For example, FIG. 1 shows well 100 being produced with a Christmas tree attached to the wellhead. The Christmas tree includes valves used to regulate flow into or out of the well 100. In some implementations, the well 100 includes a combustion chamber 203. The combustion chamber 203 can be used to combust a gas and is described in more detail later.

Figure 2A:
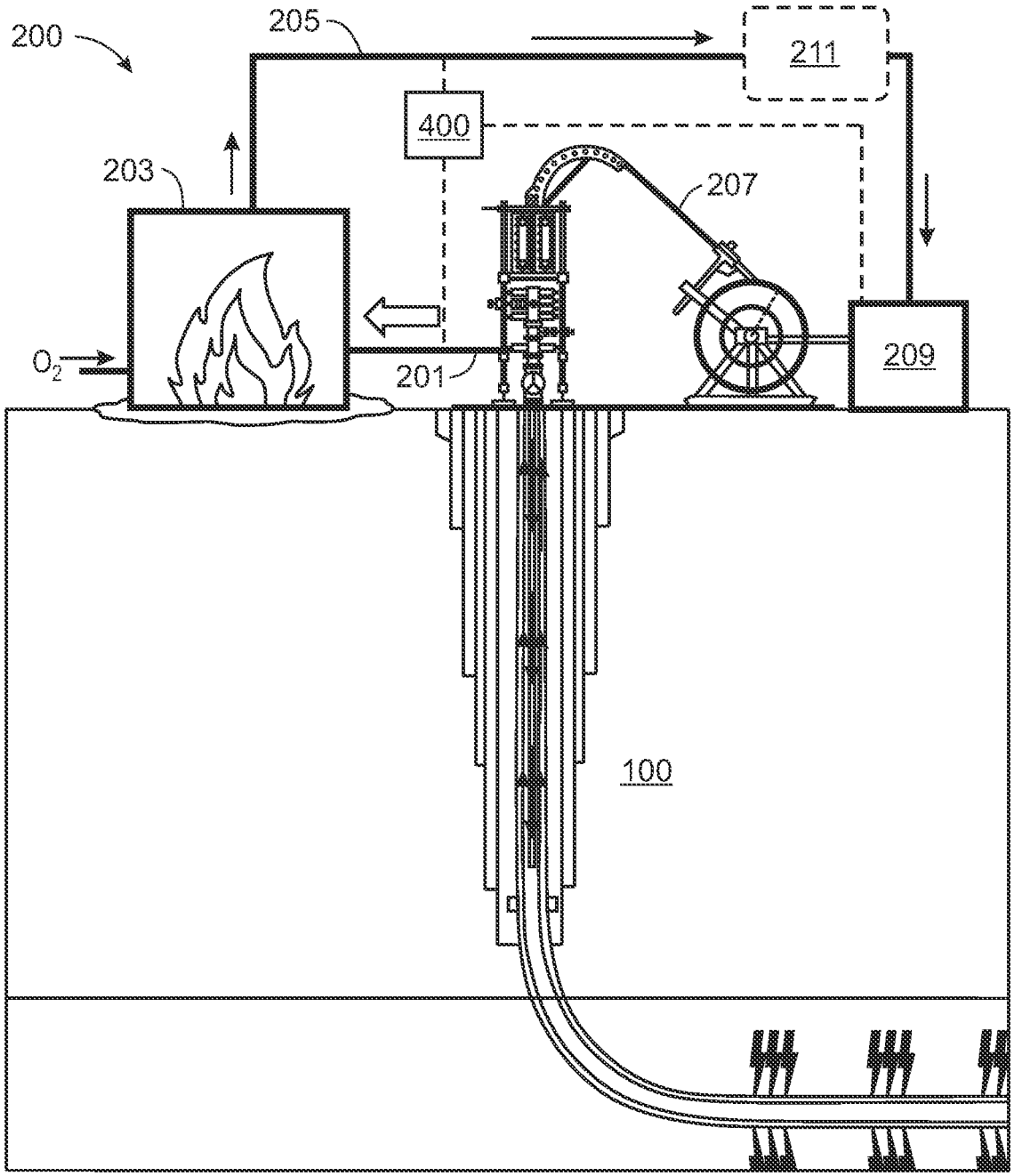
FIG. 2A is a schematic diagram of a system for a liquid unloading process in a well.

FIG. 2A is a schematic diagram of a system 200 for liquid unloading in a well (for example, the well 100). In some implementations, the well 100 has already been stimulated to promote hydrocarbon recovery from the well 100. As natural gas is produced from the well 100, liquids (for example, oil, condensate, and/or water) may accumulate over time. Liquids may accumulate due to a variety of factors, for example, a decrease in gas velocity in the well 100, a decrease in reservoir pressure, a change in gas-to-liquid ratio, or a combination of these. The accumulated liquids can negatively impact production of natural gas from the well 100. For example, as liquids accumulate in the well 100, natural gas production from the well 100 may decline due to the increase in hydrostatic pressure in the well 100. In some cases, liquid is used to stimulate the well 100, and the liquid used to stimulate the well 100 needs to be unloaded from the well 100. In some cases, the gas reservoir near the well 100 is saturated with stimulation liquid, and the liquid needs to be unloaded via the well 100. A liquid unloading process can be implemented to unload the liquid and restore natural gas production from the well 100. In some cases, gas (such as nitrogen) is pumped into the well 100 to facilitate the liquid unloading process. In this disclosure, during a liquid unloading process, natural gas produced from the well 100 is flared, and the flaring byproducts are pumped into the same well 100 to facilitate the liquid unloading process. In this way, the flaring byproducts are used instead of simply being wasted and released to the atmosphere. The use of the flaring byproducts can also reduce the use of nitrogen.

A production stream 201 is produced from the well 100. The production stream 201 includes a gaseous portion and a liquid portion. The gaseous portion can include, for example, natural gas. The liquid portion can include, for example, crude oil, gas condensate, an aqueous phase (that is, fluid including water), or a combination of these. The liquid portion has a base sediment and water (BS&W) percentage that can be measured, for example, at the surface 106. In some implementations, phases of the production stream 201 (such as the gaseous portion and the liquid portion) are separated at the surface 106.

During the liquid unloading process, at least a portion of the gaseous portion of the production stream 201 is flowed to a combustion chamber 203 and combusted in the combustion chamber 203. A source of oxygen (for example, air) can be flowed to the combustion chamber 203 to facilitate combustion of the gaseous portion of the production stream 201. Combustion of the gaseous portion of the production stream 201 produces a flaring byproduct stream 205. The flaring byproduct stream 205 can be made of mostly carbon dioxide ($CO_2$). In some implementations, the flaring byproduct stream 205 is at least 99 volume percent (vol. %) $CO_2$, at least 99.1 vol. % $CO_2$, at least 99.2 vol. % $CO_2$, at least 99.3 vol. % $CO_2$, at least 99.4 vol. % $CO_2$, at least 99.5 vol. % $CO_2$, at least 99.6 vol. % $CO_2$, or at least 99.7 vol. % $CO_2$. $CO_2$ is a well-known greenhouse gas. Typically, flaring byproducts are simply released to the atmosphere and therefore contribute to overall emissions of a facility. Instead of releasing the flaring byproduct stream 205 to the atmosphere, some or all of the flaring byproduct stream 205 is flowed to the well 100 through a coiled tubing 207. At least a portion of the flaring byproduct stream 205 can be flowed to the well 100 using, for example, a pump 209. A tubing fluidically connects the combustion chamber 203 to the pump 209, and at least a portion of the flaring byproduct stream 205 flows from the combustion chamber 203 to the pump 209 via the tubing. In some implementations, at least a portion of the flaring byproduct stream 205 is cooled before it is pumped into the well 100. In some implementations, the system 200 includes a cooler 211 that cools the flaring byproduct stream 205 before it is pumped into the well 100 by pump 209. The cooler 211 can be, for example, an air cooler or a shell-and-tube heat exchanger. The coiled tubing 207 is fluidically connected to the pump 209. The pump 209 facilitates flow of the flaring byproduct stream 205 from the combustion chamber 203 and into the well 100.

Flowing the flaring byproduct stream 205 to the well 100 can facilitate liquid unloading from the well 100. The production stream 201 continues to flow from the well 100 throughout the liquid unloading process. During the liquid unloading process, the BS&W percentage of the liquid portion of the production stream 201 can be measured, for example, using a sampler and/or a sensor. In some implementations, the system 200 includes a controller 400 that periodically communicates with the sampler and/or sensor to determine the BS&W percentage of the liquid portion of the production stream 201. The controller 400 is described in more detail later. As the liquid unloading process progresses, the BS&W percentage of the liquid portion of the production stream 201 can decrease. The BS&W percentage can be correlated to an extent of liquid accumulation in the well 100. Once the BS&W percentage has decreased enough to reach a threshold BS&W percentage, the liquid unloading process can be terminated. In some implementations, the threshold BS&W percentage is about 15%, about 10%, about 5%, about 4%, about 3%, about 2%, about 1%, or less than 1%. In some implementations, the flow rate and the pressure of the gas portion of the production stream 201 are measured. In cases where the production stream 201 is dry, once the flow rate of the gas portion of the production stream 201 has reached a threshold gas flow rate and/or the pressure of the gas portion of the production stream 201 has reached a threshold gas pressure, the liquid unloading process can be terminated.

Termination of the liquid unloading process can include stopping combustion of the gaseous portion of the production stream 201. Stopping combustion of the gaseous portion of the production stream 201 halts the production of the flaring byproduct stream 205 and therefore decreases the flow of the flaring byproduct stream 205 to the well 100. Eventually, the flow of the flaring byproduct stream 205 to the well 100 stops. Termination of the liquid unloading process can include decreasing and/or stopping pumping of the flaring byproduct stream 205 by the pump 209 to the well 100. In some implementations, the controller 400 is communicatively coupled to the pump 209. In some implementations, the controller 400 is configured to transmit a stop signal to the pump 209 to decrease and/or stop pumping of the flaring byproduct stream 205 by the pump 209 to the well 100 in response to determining that the BS&W percentage measured by the sampler and/or sensor has reached the threshold BS&W percentage. In some implementations, the well 100 is connected to a gas processing plant after flow of the flaring byproduct stream 205 to the well 100 stops. Then the production stream 201 flows to the gas processing plant instead of being flowed to the combustion chamber 203 and back into the well 100. In some implementations, the well 100 is connected to a gas pipeline (for example, for transport to a gas processing plant) after flow of the flaring byproduct stream 205 to the well 100 stops. Then the production stream 201 flows to the gas pipeline instead of being flowed to the combustion chamber 203 and back into the well 100.

Figure 2B:
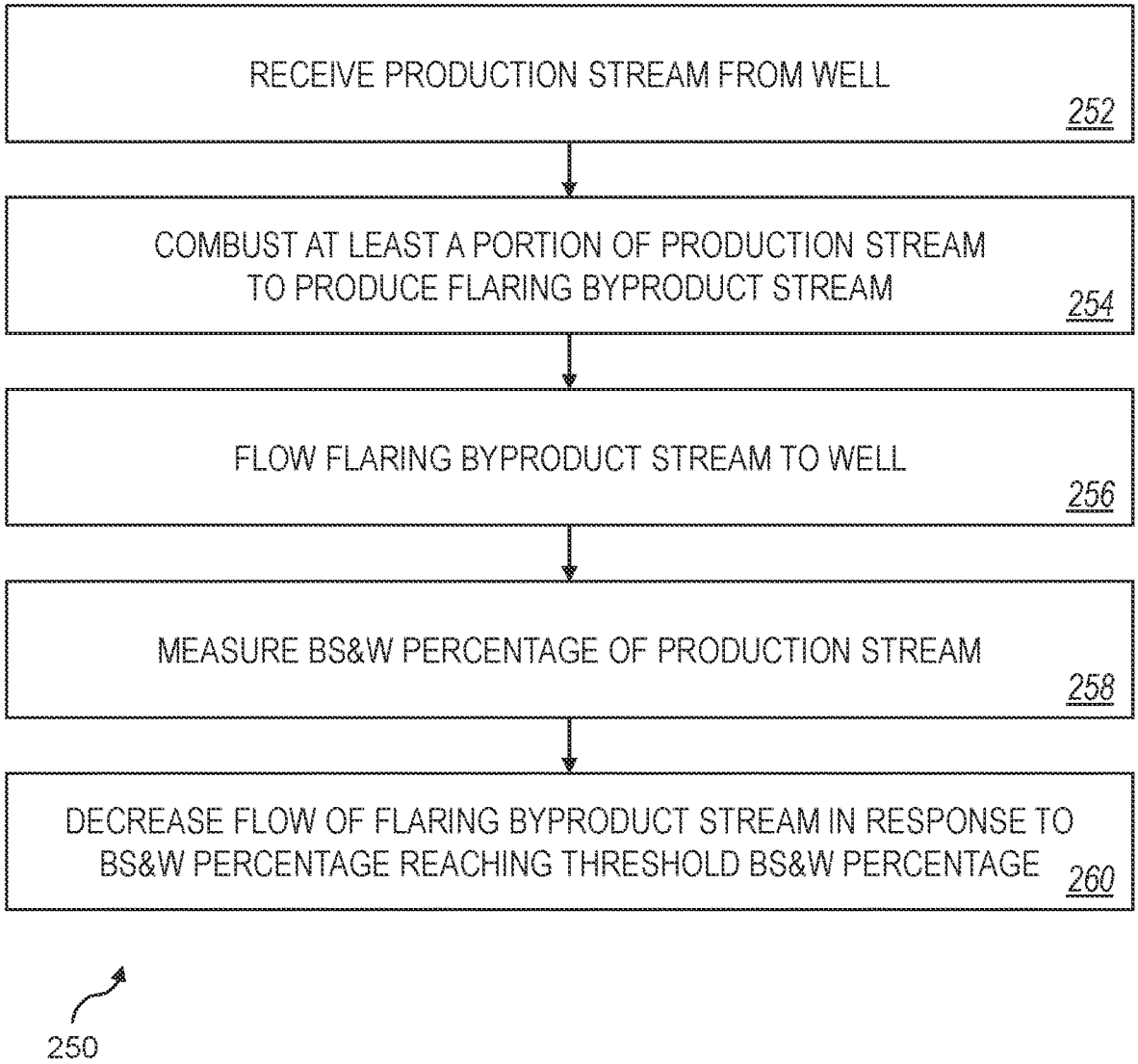
FIG. 2B is a flow chart for a liquid unloading process for a well.

FIG. 2B is a flow chart for a liquid unloading process 250 for a well (for example, the well 100). The system 200 can implement the liquid unloading process 250. As described previously, the well 100 is formed in a subterranean formation. In some implementations, the well 100 has been stimulated (for example, by using a stimulation liquid) before implementing the liquid unloading process 250. At block 252, a production stream (201) is received from the well 100. As described previously, the production stream 201 includes a gaseous portion and a liquid portion. The liquid portion has a BS&W percentage that can be measured. At block 254, at least a portion of gaseous portion of the production stream 201 is combusted to produce a flaring byproduct stream (205). At block 256, the flaring byproduct stream 205 is flowed through a coiled tubing (207) to the well 100. In some implementations, the flaring byproduct stream 205 is cooled before being flowed to the well 100 at block 256.

At block 258, a BS&W percentage of the liquid portion of the production stream 201 is measured. At block 260, the flow of the flaring byproduct stream 205 to the well 100 is decreased in response to the BS&W percentage reaching a threshold BS&W percentage. In some implementations, the threshold BS&W percentage is about 15%, about 10%, about 5%, about 4%, about 3%, about 2%, about 1%, or less than 1%. The flow of the flaring byproduct stream 205 to the well 100 can be decreased at block 260 by decreasing the amount of the gaseous portion of the production stream 201 that is combusted at block 254. By decreasing the amount of the production stream 201 that is combusted, the amount of flaring byproducts produced is decreased. In some implementations, the flow of the flaring byproduct stream 205 to the well 100 is decreased at block 260 until the flow of the flaring byproduct stream 205 to the well 100 stops (that is, the flow rate of the flaring byproduct stream 205 reaches zero). In some implementations, the well 100 is connected to a gas processing plant after flow of the flaring byproduct stream 205 to the well 100 stops. Then the production stream 201 flows to the gas processing plant instead of being flowed to the combustion chamber 203 and back into the well 100. In some implementations, the well 100 is connected to a gas pipeline (for example, for transport to a gas processing plant) after flow of the flaring byproduct stream 205 to the well 100 stops. Then the production stream 201 flows to the gas pipeline instead of being flowed to the combustion chamber 203 and back into the well 100.

Figure 3A:
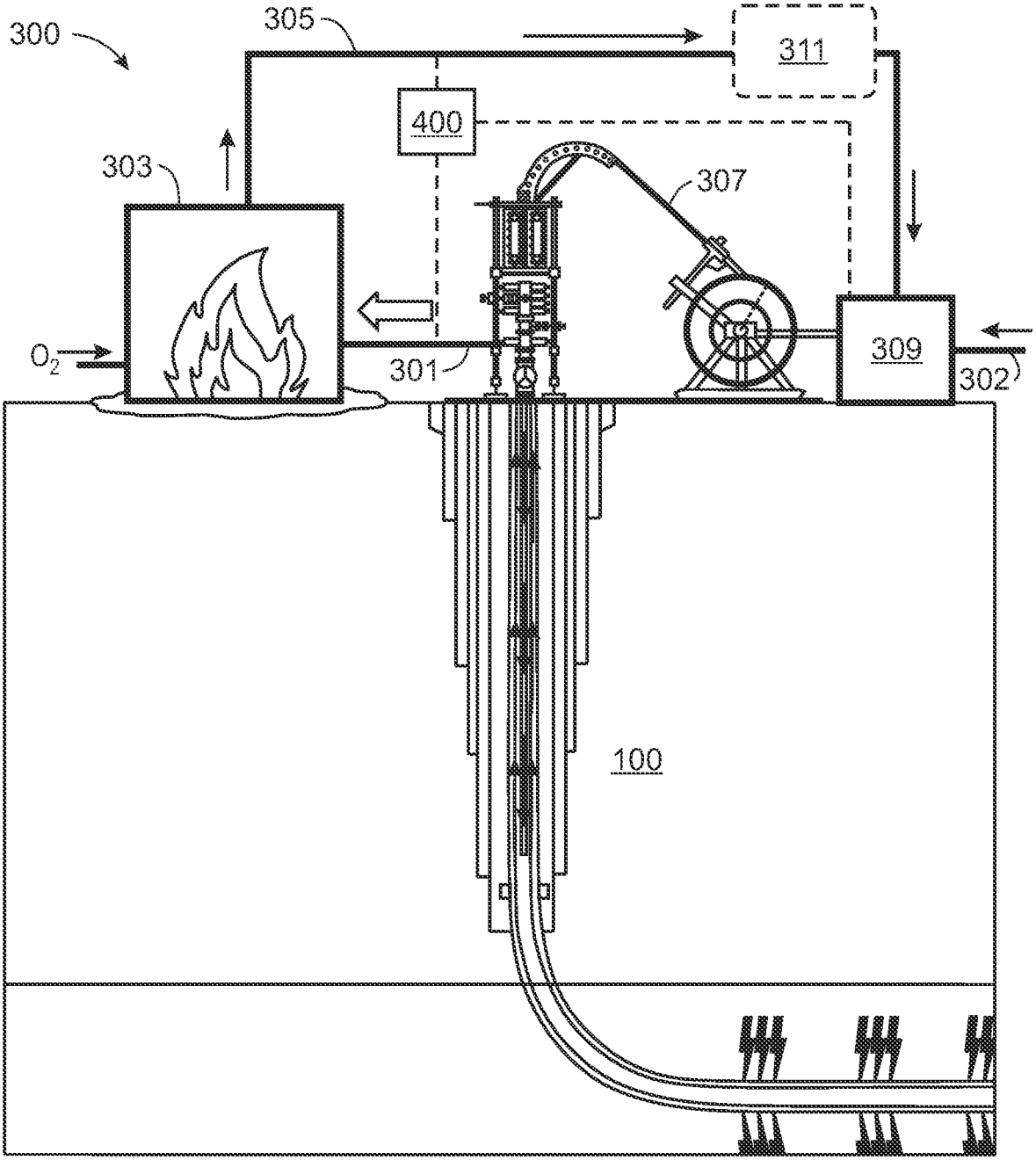
FIG. 3A is a schematic diagram of a system for a liquid unloading process in a well.

FIG. 3A is a schematic diagram of a system 300 for liquid unloading in a well (for example, the well 100). A production stream 301 is produced from the well 100. In some implementations, the production stream 301 is substantially the same as the production stream 201 shown in FIG. 2A. The production stream 301 includes a gaseous portion and a liquid portion. The gaseous portion can include, for example, natural gas. The liquid portion can include, for example, crude oil, gas condensate, an aqueous phase (that is, fluid including water), or a combination of these. The liquid portion has a base sediment and water (BS&W) percentage that can be measured, for example, at the surface 106. In some implementations, phases of the production stream 301 (such as the gaseous portion and the liquid portion) are separated at the surface 106. In some cases, pressure in the reservoir (also referred as reservoir pressure) is insufficient to meet a desired flow rate from the well 100 during the liquid unloading process. To promote flow of the production stream 301 from the well 100, a nitrogen stream 302 is flowed to the well 100 through a coiled tubing 307. The nitrogen stream 302 includes nitrogen ($N_2$). In some implementations, the coiled tubing 307 is substantially the same as the coiled tubing 207 shown in FIG. 2A. The nitrogen stream 302 can be flowed to the well 100 using, for example, a pump 309. In some implementations, the pump 309 is substantially the same as the pump 209 shown in FIG. 2A.

During the liquid unloading process, at least a portion of the gaseous portion of the production stream 301 is flowed to a combustion chamber 303 and combusted in the combustion chamber 303. In some implementations, the combustion chamber 303 is substantially the same as the combustion chamber 203 shown in FIG. 2A. A source of oxygen (for example, air) can be flowed to the combustion chamber 303 to facilitate combustion of the gaseous portion of the production stream 301. Combustion of the gaseous portion of the production stream 301 produces a flaring byproduct stream 305. In some implementations, the flaring byproduct stream 305 is substantially the same as the flaring byproduct stream 205 shown in FIG. 2A. The flaring byproduct stream 305 can be made of mostly $CO_2$. In some implementations, the flaring byproduct stream 305 is about 99 vol. % $CO_2$, at least 99 vol. % $CO_2$, at least 99.1 vol. % $CO_2$, at least 99.2 vol. % $CO_2$, at least 99.3 vol. % $CO_2$, at least 99.4 vol. % $CO_2$, at least 99.5 vol. % $CO_2$, at least 99.6 vol. % $CO_2$, or at least 99.7 vol. % $CO_2$. Instead of releasing the flaring byproduct stream 305 to the atmosphere, some or all of the flaring byproduct stream 305 is flowed to the well 100 through the coiled tubing 307. At least a portion of the flaring byproduct stream 305 can be flowed with the nitrogen stream 302 to the well 100 through the coiled tubing 307. A tubing fluidically connects the combustion chamber 303 to the pump 309, and at least a portion of the flaring byproduct stream 305 flows from the combustion chamber 303 to the pump 309 via the tubing. At least a portion of the flaring byproduct stream 305 can be flowed to the well 100 using, for example, the pump 309. In some implementations, at least a portion of the flaring byproduct stream 305 is cooled before it is pumped into the well 100. In some implementations, the system 300 includes a cooler 311 that cools the flaring byproduct stream 305 before it is pumped into the well 100 by pump 309. In some implementations, the cooler 311 is substantially the same as the cooler 211 shown in FIG. 2A. The coiled tubing 307 is fluidically connected to the pump 309. The pump 309 facilitates flow of the flaring byproduct stream 305 from the combustion chamber 303 and into the well 100.

Flowing the flaring byproduct stream 305 and the nitrogen stream 302 to the well 100 can facilitate liquid unloading from the well 100. The production stream 301 continues to flow from the well 100 throughout the liquid unloading process. Because the flaring byproduct stream 305 is produced by combustion of the gaseous portion of the production stream 301, the flow rate of the production stream 301 from the well 100 is directly related to the flow rate of the flaring byproduct stream 305. The flow rate of the flaring byproduct stream 305 can be measured, for example, using a flowmeter. In some implementations, the controller 400 is communicatively coupled to the flowmeter and periodically communicates with the flowmeter to determine the flow rate of the flaring byproduct stream 305. Once the flow rate of the flaring byproduct stream 305 reaches a threshold flow rate, the flow of the nitrogen stream 302 to the well 100 can be decreased. In some implementations, the controller 400 is communicatively coupled to a control valve that can be adjusted to control the flow rate of the nitrogen stream 302. In some implementations, the controller 400 is configured to transmit a signal to the control valve to decrease and/or stop the flow of the nitrogen stream 302 to the pump 309 in response to determining that the flow rate of the flaring byproduct stream 305 has reached the threshold flow rate. In some implementations, the threshold flow rate is about 700 standard cubic feet per minute (SCFM). In some implementations, the flow rate of the nitrogen stream 302 is adjusted (for example, by the controller 400), such that the total flow rate of the nitrogen stream 302 and the flaring byproduct stream 305 equals the threshold flow rate. As one example, at the beginning of the liquid unloading process, the nitrogen stream 302 is flowed at a flow rate equal to the threshold flow rate. As the production stream 301 flows from the well 100 and is combusted to produce the flaring byproduct stream 305, the flaring byproduct stream 305 contributes to the overall flow along with the nitrogen stream 302 to the well 100 through the coiled tubing 307. As the flow rate of the flaring byproduct stream 305 increases, the flow rate of the nitrogen stream 302 can be decreased, such that the total flow rate of the nitrogen stream 302 and the flaring byproduct stream 305 equals the threshold flow rate. Once the flow rate of the flaring byproduct stream 305 reaches the threshold flow rate, the flow of the nitrogen stream 302 to the well 100 can be terminated (that is, the flow rate of the nitrogen stream 302 reaches zero). The flow rate of the nitrogen stream 302 throughout these steps can be automatically controlled, for example, by the controller 400.

During the liquid unloading process, the BS&W percentage of the liquid portion of the production stream 301 can be measured, for example, using a sampler and/or a sensor. In some implementations, the system 300 includes a controller 400 that periodically communicates with the sampler and/or sensor to determine the BS&W percentage of the liquid portion of the production stream 301. As the liquid unloading process progresses, the BS&W percentage of the liquid portion of the production stream 301 can decrease. Once the BS&W percentage has decreased enough to reach a threshold BS&W percentage, the liquid unloading process can be terminated. In some implementations, the threshold BS&W percentage is about 15%, about 10%, about 5%, about 4%, about 3%, about 2%, about 1%, or less than 1%. Termination of the liquid unloading process can include stopping combustion of the gaseous portion of the production stream 301. Stopping combustion of the gaseous portion of the production stream 301 halts the production of the flaring byproduct stream 305 and therefore decreases the flow of the flaring byproduct stream 305 to the well 100. Eventually, the flow of the flaring byproduct stream 305 to the well 100 stops. Termination of the liquid unloading process can include decreasing and/or stopping pumping of the flaring byproduct stream 305 by the pump 309 to the well 100. In some implementations, the controller 400 is communicatively coupled to the pump 309. In some implementations, the controller 400 is configured to transmit a stop signal to the pump 309 to decrease and/or stop pumping of the flaring byproduct stream 305 by the pump 309 to the well 100 in response to determining that the BS&W percentage measured by the sampler and/or sensor has reached the threshold BS&W percentage. In some implementations, the well 100 is connected to a gas processing plant after flow of the flaring byproduct stream 305 to the well 100 stops. Then the production stream 301 flows to the gas processing plant instead of being flowed to the combustion chamber 303 and back into the well 100. In some implementations, the well 100 is connected to a gas pipeline (for example, for transport to a gas processing plant) after flow of the flaring byproduct stream 305 to the well 100 stops. Then the production stream 301 flows to the gas pipeline instead of being flowed to the combustion chamber 303 and back into the well 100.

Figure 3B:
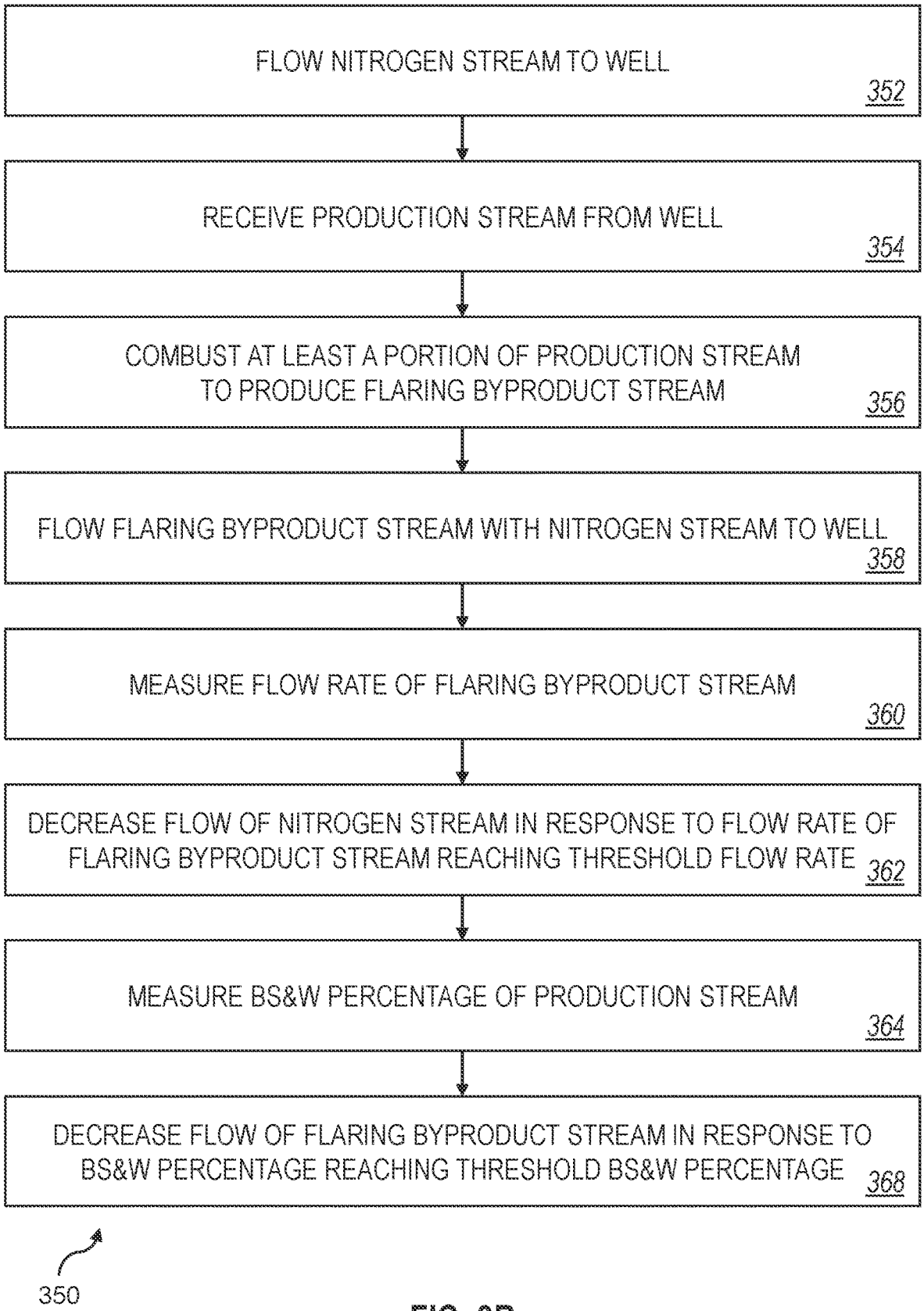
FIG. 3B is a flow chart for a liquid unloading process for a well.

FIG. 3B is a flow chart for a liquid unloading process 350 for a well (for example, the well 100). The system 300 can implement the liquid unloading process 350. As described previously, the well 100 is formed in a subterranean formation. In some implementations, the well 100 has been stimulated (for example, by using a stimulation liquid) before implementing the liquid unloading process 350. At block 352, a quantity of a nitrogen stream (302) is flowed through a coiled tubing (307) to the well 100 to begin the liquid unloading process 350. At block 354, a production stream (301) is received from the well 100 in response to flowing the nitrogen stream 302 at block 352. At block 356, at least a portion of the production stream 301 (for example, a gaseous portion of the production stream 301) is combusted to produce a flaring byproduct stream (305). At block 358, a quantity of the flaring byproduct stream 305 is flowed with the nitrogen stream 302 through the coiled tubing 307 to the well 100 to continue the liquid unloading process 350. In some implementations, the flaring byproduct stream 305 is cooled before being flowed to the well 100 at block 358.

At block 360, a flow rate of the flaring byproduct stream 305 is measured (for example, using a flowmeter). At block 362, the flow of the nitrogen stream 302 to the well 100 is decreased in response to the flow rate of the flaring byproduct stream 305 reaching a threshold flow rate. In some implementations, the threshold flow rate is about 700 SCFM. In some implementations, the quantity by which the flow rate of the nitrogen stream 302 to the well 100 is decreased at block 362 is equal to an increase in the flow rate of the flaring byproduct stream 305 to the well 100 from block 358 to block 362 (for example, a difference between the threshold flow rate and an initial flow rate of the flaring byproduct stream 305). In some implementations, the flow of the nitrogen stream 302 to the well 100 is decreased at block 362 until the flow of the nitrogen stream 302 to the well 100 stops (that is, the flow rate of the nitrogen stream 302 reaches zero).

At block 364, a BS&W percentage of the production stream 301 is measured. In some implementations, the BS&W percentage of the liquid portion of the production stream 301 is measured at block 364. At block 368, the flow of the flaring byproduct stream 305 to the well 100 is decreased in response to the BS&W percentage reaching a threshold BS&W percentage. In some implementations, the threshold BS&W percentage is about 15%, about 10%, about 5%, about 4%, about 3%, about 2%, about 1%, or less than 1%. The flow of the flaring byproduct stream 305 to the well 100 can be decreased at block 368 by decreasing the amount of the production stream 301 that is combusted. By decreasing the amount of the production stream 301 that is combusted, the amount of flaring byproducts produced is decreased. In some implementations, the flow of the flaring byproduct stream 305 to the well 100 is decreased at block 368 until the flow of the flaring byproduct stream 305 to the well 100 stops (that is, the flow rate of the flaring byproduct stream 305 reaches zero). In some implementations, the well 100 is connected to a gas processing plant after flow of the flaring byproduct stream 305 to the well 100 stops. Then the production stream 301 flows to the gas processing plant instead of being flowed to the combustion chamber 303 and back into the well 100. In some implementations, the well 100 is connected to a gas pipeline (for example, for transport to a gas processing plant) after flow of the flaring byproduct stream 305 to the well 100 stops. Then the production stream 301 flows to the gas pipeline instead of being flowed to the combustion chamber 303 and back into the well 100.

Figure 4:
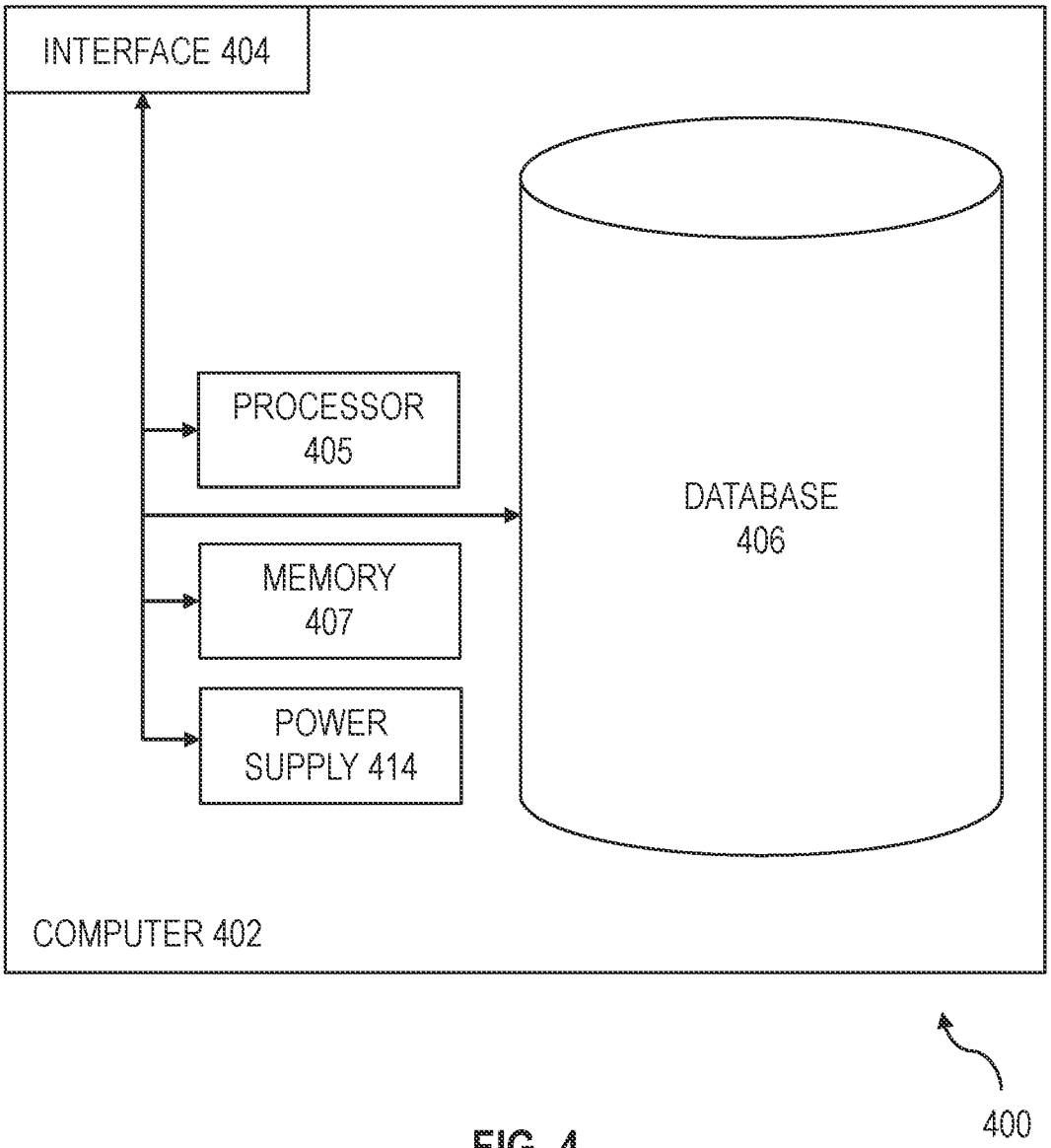
FIG. 4 is a block diagram of an example controller that can be implemented in the system of FIG. 2A or FIG. 2B.

FIG. 4 is a block diagram of an implementation of the controller 400 used to provide computational functionalities associated with described algorithms, methods, functions, processes, flows, and procedures, as described in this specification, according to an implementation. The illustrated computer 402 is intended to encompass any computing device such as a server, desktop computer, laptop/notebook computer, one or more processors within these devices, or any other processing device, including physical or virtual instances (or both) of the computing device. Additionally, the computer 402 can include a computer that includes an input device, such as a keypad, keyboard, touch screen, or other device that can accept user information, and an output device that conveys information associated with the operation of the computer 402, including digital data, visual, audio information, or a combination of information.

The computer 402 includes an interface 404. Although illustrated as a single interface 404 in FIG. 4, two or more interfaces 404 may be used according to particular needs, desires, or particular implementations of the computer 402. Although not shown in FIG. 4, the computer 402 can be communicably coupled with a network. The interface 404 is used by the computer 402 for communicating with other systems that are connected to the network in a distributed environment. Generally, the interface 404 comprises logic encoded in software or hardware (or a combination of software and hardware) and is operable to communicate with the network. More specifically, the interface 404 may comprise software supporting one or more communication protocols associated with communications such that the network or interface's hardware is operable to communicate physical signals within and outside of the illustrated computer 402.

The computer 402 includes a processor 405. Although illustrated as a single processor 405 in FIG. 4, two or more processors may be used according to particular needs, desires, or particular implementations of the computer 402. Generally, the processor 405 executes instructions and manipulates data to perform the operations of the computer 402 and any algorithms, methods, functions, processes, flows, and procedures as described in this specification.

The computer 402 can also include a database 406 that can hold data for the computer 402 or other components (or a combination of both) that can be connected to the network. Although illustrated as a single database 406 in FIG. 4, two or more databases (of the same or combination of types) can be used according to particular needs, desires, or particular implementations of the computer 402 and the described functionality. While database 406 is illustrated as an integral component of the computer 402, database 406 can be external to the computer 402.

The computer 402 also includes a memory 407 that can hold data for the computer 402 or other components (or a combination of both) that can be connected to the network. Although illustrated as a single memory 407 in FIG. 4, two or more memories 407 (of the same or combination of types) can be used according to particular needs, desires, or particular implementations of the computer 402 and the described functionality. While memory 407 is illustrated as an integral component of the computer 402, memory 407 can be external to the computer 402. The memory 407 can be a transitory or non-transitory storage medium.

The memory 407 stores computer-readable instructions executable by the processor 405 that, when executed, cause the processor 405 to perform operations, such as communicate with a sampler and/or a sensor to measure a flow rate of the production stream (201 or 301), communicate with a sampler and/or sensor to measure a flow rate of the flaring byproduct stream (205 or 305), communicate with a sampler and/or a sensor to measure a BS&W percentage of the production stream (201 or 301), any of the blocks of the process 250, any of the blocks of the process 350, or any combination of these. The computer 402 can also include a power supply 414. The power supply 414 can include a rechargeable or non-rechargeable battery that can be configured to be either user- or non-user-replaceable. The power supply 414 can be hard-wired. There may be any number of computers 402 associated with, or external to, a computer system containing computer 402, each computer 402 communicating over the network. Further, the term "client," "user," "operator," and other appropriate terminology may be used interchangeably, as appropriate, without departing from this specification. Moreover, this specification contemplates that many users may use one computer 402, or that one user may use multiple computers 402.

While this specification contains many specific implementation details, these should not be construed as limitations on the scope of what may be claimed, but rather as descriptions of features that may be specific to particular implementations. Certain features that are described in this specification in the context of separate implementations can also be implemented, in combination, in a single implementation. Conversely, various features that are described in the context of a single implementation can also be implemented in multiple implementations, separately, or in any sub-combination. Moreover, although previously described features may be described as acting in certain combinations and even initially claimed as such, one or more features from a claimed combination can, in some cases, be excised from the combination, and the claimed combination may be directed to a sub-combination or variation of a sub-combination.

As used in this disclosure, the terms "a," "an," or "the" are used to include one or more than one unless the context clearly dictates otherwise. The term "or" is used to refer to a nonexclusive "or" unless otherwise indicated. The statement "at least one of A and B" has the same meaning as "A, B, or A and B." In addition, it is to be understood that the phraseology or terminology employed in this disclosure, and not otherwise defined, is for the purpose of description only and not of limitation. Any use of section headings is intended to aid reading of the document and is not to be interpreted as limiting; information that is relevant to a section heading may occur within or outside of that particular section.

As used in this disclosure, the term "about" or "approximately" can allow for a degree of variability in a value or range, for example, within 10%, within 5%, or within 1% of a stated value or of a stated limit of a range.

As used in this disclosure, the term "substantially" refers to a majority of, or mostly, as in at least about 50%, 60%, 70%, 80%, 90%, 95%, 96%, 97%, 98%, 99%, 99.5%, 99.9%, 99.99%, or at least about 99.999% or more.

Values expressed in a range format should be interpreted in a flexible manner to include not only the numerical values explicitly recited as the limits of the range, but also to include all the individual numerical values or sub-ranges encompassed within that range as if each numerical value and sub-range is explicitly recited. For example, a range of "0.1% to about 5%" or "0.1% to 5%" should be interpreted to include about 0.1% to about 5%, as well as the individual values (for example, 1%, 2%, 3%, and 4%) and the sub-ranges (for example, 0.1% to 0.5%, 1.1% to 2.2%, 3.3% to 4.4%) within the indicated range. The statement "X to Y" has the same meaning as "about X to about Y," unless indicated otherwise. Likewise, the statement "X, Y, or Z" has the same meaning as "about X, about Y, or about Z," unless indicated otherwise.

Particular implementations of the subject matter have been described. Other implementations, alterations, and permutations of the described implementations are within the scope of the following claims as will be apparent to those skilled in the art. While operations are depicted in the drawings or claims in a particular order, this should not be understood as requiring that such operations be performed in the particular order shown or in sequential order, or that all illustrated operations be performed (some operations may be considered optional), to achieve desirable results. In certain circumstances, multitasking or parallel processing (or a combination of multitasking and parallel processing) may be advantageous and performed as deemed appropriate.

Moreover, the separation or integration of various system modules and components in the previously described implementations should not be understood as requiring such separation or integration in all implementations, and it should be understood that the described components and systems can generally be integrated together or packaged into multiple products.

Accordingly, the previously described example implementations do not define or constrain the present disclosure. Other changes, substitutions, and alterations are also possible without departing from the spirit and scope of the present disclosure.

What is claimed is:

1. A method comprising:

flowing a quantity of a nitrogen stream through a coiled tubing to a well formed in a subterranean formation to begin a liquid unloading process in the well;

receiving a production stream from the well in response to flowing the nitrogen stream;

combusting at least a portion of the production stream to produce a flaring byproduct stream;

flowing a quantity of the flaring byproduct stream with the nitrogen stream through the coiled tubing to the well to continue the liquid unloading process in the well;

measuring a flow rate of the flaring byproduct stream;

in response to the flow rate of the flaring byproduct stream reaching a threshold flow rate, decreasing the flow of the nitrogen stream to the well;

measuring a base sediment and water (BS&W) percentage of the production stream; and in response to the BS&W percentage reaching a threshold BS&W percentage, decreasing the flow of the flaring byproduct stream to the well.

2. The method of claim 1, wherein the threshold flow rate is about 700 standard cubic feet per minute (SCFM).

3. The method of claim 1, wherein the threshold BS&W percentage is about 10%.

4. The method of claim 1, wherein the flaring byproduct stream comprises about 99 volume percent (vol. %) of carbon dioxide.

5. The method of claim 1, comprising cooling the flaring byproduct stream before flowing the flaring byproduct stream with the nitrogen stream through the coiled tubing to the well.

6. The method of claim 1, wherein the flow of the nitrogen stream to the well is decreased until the flow of the nitrogen stream to the well stops.

7. The method of claim 1, wherein the flow of the flaring byproduct stream to the well is decreased until the flow of the flaring byproduct stream to the well stops.

8. The method of claim 7, comprising fluidically connecting the well to a gas processing plant after the flow of the flaring byproduct stream to the well stops.

9. The method of claim 7, comprising fluidically connecting the well to a gas pipeline after the flow of the flaring byproduct stream to the well stops.

10. A method comprising:

receiving a production stream from a well formed in a subterranean formation, wherein the production stream comprises a gaseous portion and a liquid portion having a base sediment and water (BS&W) percentage;

combusting at least a portion of the gaseous portion of the production stream to produce a flaring byproduct stream;

flowing the flaring byproduct stream through a coiled tubing to the well;

measuring the BS&W percentage of the liquid portion of the production stream; and in response to the BS&W percentage reaching a threshold BS&W percentage, decreasing the flow of the flaring byproduct stream to the well.

11. The method of claim 10, wherein the threshold BS&W percentage is about 10%.

12. The method of claim 10, wherein the flaring byproduct stream comprises at least 99 volume percent (vol. %) of carbon dioxide.

13. The method of claim 10, comprising cooling the flaring byproduct stream before flowing the flaring byproduct stream through the coiled tubing to the well.

14. The method of claim 10, wherein the flow of the flaring byproduct stream to the well is decreased until the flow of the flaring byproduct stream to the well stops.

15. The method of claim 14, comprising fluidically connecting the well to a gas processing plant after the flow of the flaring byproduct stream to the well stops.

16. The method of claim 14, comprising fluidically connecting the well to a gas pipeline after the flow of the flaring byproduct stream to the well stops.

* * * * *